US005878761A

United States Patent [19]

Vadher

[11] Patent Number: 5,878,761

[45] Date of Patent: Mar. 9, 1999

[54] DEVICE FOR ATTACHING TO A TORSO AND SUPPORTING A POP-UP UMBRELLA UPRIGHT WITHOUT THE USE OF HANDS

[76] Inventor: Dinesh L. Vadher, 20 Alta Vista, Belle Terre, N.Y. 11777

[21] Appl. No.: 16,965

[22] Filed: Feb. 2, 1998

[51] Int. Cl.[6] ..... A45B 5/00

[52] U.S. Cl. ..... 135/16; 224/915; 224/188; 224/625; 224/623; 224/580

[58] Field of Search ..... 135/16; 224/259, 224/251, 915, 188, 186, 190, 623, 625, 580

[56] References Cited

U.S. PATENT DOCUMENTS

| | | |
|---|---|---|
| 903,682 | 11/1908 | Cumpston . |
| 1,006,194 | 10/1911 | Fourcher . |
| 1,460,821 | 7/1923 | Morris . |
| 1,466,715 | 9/1923 | Hart . |
| 1,704,407 | 3/1929 | Rice . |
| 2,223,253 | 11/1940 | Hamilton . |
| 3,204,650 | 9/1965 | Shinew . |
| 3,554,203 | 1/1971 | Hall, Sr. . |
| 3,700,149 | 10/1972 | Grogan . |
| 3,730,197 | 5/1973 | Lunney . |
| 4,537,339 | 8/1985 | Pearson . |
| 4,892,240 | 1/1990 | Bell . |
| 5,353,977 | 10/1994 | Schiro, Jr. et al. . |
| 5,544,792 | 8/1996 | Arnwine . |

*Primary Examiner*—Lanna Mai

[57] ABSTRACT

A holding device for attaching to a torso and supporting a pop-up umbrella upright without the use of hands of a wearer and has an in-use position where it is releasibly attached to the torso of the wearer and a non-use position where it is removed from the torso of the wearer and stowed away for easy transport. The holding device includes a carrying case that has an open position when the holding device is in its in-use position and a closed position when the holding device is in its non-use position, a sleeve pivotally mounted in the carrying case, a pop-up umbrella that has an open position, a closed position, and a shaft captured in the sleeve for lateral pivotal movement therewith so as to allow the pop-up umbrella to pivot away from the wearer before being opened and thereby prevent injury to the wearer when the carrying case is in its open position and the holding device is in its in-use position, and apparatus for releasibly attaching the carrying case to the torso of the wearer when the carrying case is in its open position and the holding device is in its in-use position.

13 Claims, 4 Drawing Sheets

DEVICE FOR ATTACHING TO A TORSO AND SUPPORTING A POP-UP UMBRELLA UPRIGHT WITHOUT THE USE OF HANDS

BACKGROUND OF THE INVENTION

1. Field of the Invention

The present invention relates to a device for supporting an umbrella. More particularly, the present invention relates to a device for attaching to a torso and supporting a pop-up umbrella upright without the use of hands.

2. Description of the Prior Art

An umbrella requires a user to employ at least one hand to hold the umbrella shaft by its handle. When it is necessary for both hands to be free, one cannot also hold an umbrella. When an umbrella is to be held for a long period of time, it becomes very tiresome. Thus, in each of these situations, it is desired that an umbrella not be supported by the hands of the user.

Numerous innovations for devices for supporting an umbrella without the use of hands have been provided in the prior art that will be described. Even though these innovations may be suitable for the specific individual purposes to which they address, however, they differ from the present invention.

FOR EXAMPLE, U.S. Pat. No. Des. 361,654 to Petracco teaches the ornamental design for a combined umbrella and body attachable support.

ANOTHER EXAMPLE, U.S. Pat. No. 1,657,263 to Lauby teaches an umbrella holder comprising a belt having an adjustable buckle and adapted to surround the waist of a wearer, a looped member carried by the belt and adapted to receive the handle of an umbrella while permitting rocking of the handle, a shoulder strap having its ends secured to the belt, and means carried by the shoulder strap and adapted to detachably lock the stem of the umbrella to the shoulder strap.

STILL ANOTHER EXAMPLE, U.S. Pat. No. 2,085,984 to Kruithof teaches an umbrella holder comprising a stiff backing, a sheet of flexible material secured to the backing with its intermediate portion projecting forwardly from the front face of the backing to provide a pocket open at its top, a block thrust into the pocket through the open end thereof and fitting snugly therein with its upper end spaced downwardly from the upper end of the pocket. The block is formed with an axially extending socket leading from its upper end. The portion of the pocket extending upwardly from the block is of a length adapting it to be folded rearwardly over the upper end of the block against the backing. Means detachably secure the folded upper portion of the pocket against the backing in overlying relationship to the block. The upper portion of the pocket is formed with a slot whereby the staff of an umbrella may be thrust downwardly through the slot and into the socket of the block. Means carried by the backing secures the holder in an upright position against a person's body.

YET ANOTHER EXAMPLE, U.S. Pat. No. 3,700,149 to Grogan teaches an elongated hollow substantially rigid member adapted to receive the shaft of an umbrella, and having an elongated filament slidably connected with the elongated hollow member and extending the length of the hollow member. The filament having the central portion thereof formed as a loop adapted to surround the wearer by going over one shoulder and under the opposed arm of the wearer, and the terminal ends thereof surrounding the waist of the wearer. Means secure the terminal ends. Also included is means adapting the elongated hollow member to receive umbrella shafts of different diameters. Insertable means releasably secure the umbrella shaft within the elongated hollow member.

STILL YET ANOTHER EXAMPLE, U.S. Pat. No. 4,537,339 to Pearson teaches an umbrella support that includes a planar support having upper and lower pockets thereon to receive a curved or straight handle of a short or long umbrella shaft, respectively, of an umbrella to be supported. The support is mounted on the front or back of a user's body. When mounted on the back, the angle of the planar support to the user's body can be varied by a pivotally mounted plate at the bottom of the planar support engaging the user's body at various angles. The upper end of the planar support has guide passages to receive a portion of the umbrella shaft and retain it therein. Leather straps secure the umbrella shaft to the planar support between the upper or lower pocket in which the handle end of the shaft is supported and the passages in the guides. The upper end of the planar support has a pivotally mounted plate with slots therein to receive the umbrella shaft when the plate is in a horizontal position. In this position, the umbrella shaft cannot pass through the guide passages so that the angle of the umbrella to the planar support is different. Each of the slots in the pivotally mounted plate retains the umbrella shaft therein.

FINALLY, YET STILL ANOTHER EXAMPLE, U.S. Pat. No. 5,513,786 to Drane teaches an umbrella holder which straps to an individual's torso and is adapted to hold an open umbrella upright so as to permit the user's hands to be unencumbered. The umbrella holder includes a harness having a shoulder strap which crosses the back and chest of the user at an oblique angle and engages a waist belt. A support member which secures the umbrella to the harness extends generally perpendicular from the belt and engages the shoulder strap. The shoulder forms a brace which provides lateral support to the support member to maintain the umbrella in its upright orientation.

It is apparent that numerous innovations for devices for supporting an umbrella without the use of hands have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a holding device for attaching to a torso and supporting an umbrella upright without the use of hands that avoids the disadvantages of the prior art.

ANOTHER OBJECT of the present invention is to provide a holding device for attaching to a torso and supporting an umbrella upright without the use of hands that is simple and inexpensive to manufacture.

STILL ANOTHER OBJECT of the present invention is to provide a holding device for attaching to a torso and supporting an umbrella upright without the use of hands that is simple to use.

BRIEFLY STATED, YET ANOTHER OBJECT of the present invention is to provide a holding device for attaching to a torso and supporting a pop-up umbrella upright without the use of hands of a wearer and has an in-use position where it is releasibly attached to the torso of the wearer and a non-use position where it is removed from the torso of the wearer and stowed away for easy transport. The holding device includes a carrying case that has an open position when the holding device is in its in-use position and a closed position when the holding device is in its non-use position, a sleeve pivotally mounted in the carrying case, a pop-up umbrella that has an open position, a closed position, and a shaft captured in the sleeve for lateral pivotal movement therewith so as to allow the pop-up umbrella to pivot away from the wearer before being opened and thereby prevent injury to the wearer when the carrying case is in its open position and the holding device is its in-use position, and apparatus for releasibly attaching the carrying case to the torso of the wearer when the carrying case is in its open position and the holding device is in its in-use position.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

Figure 1:
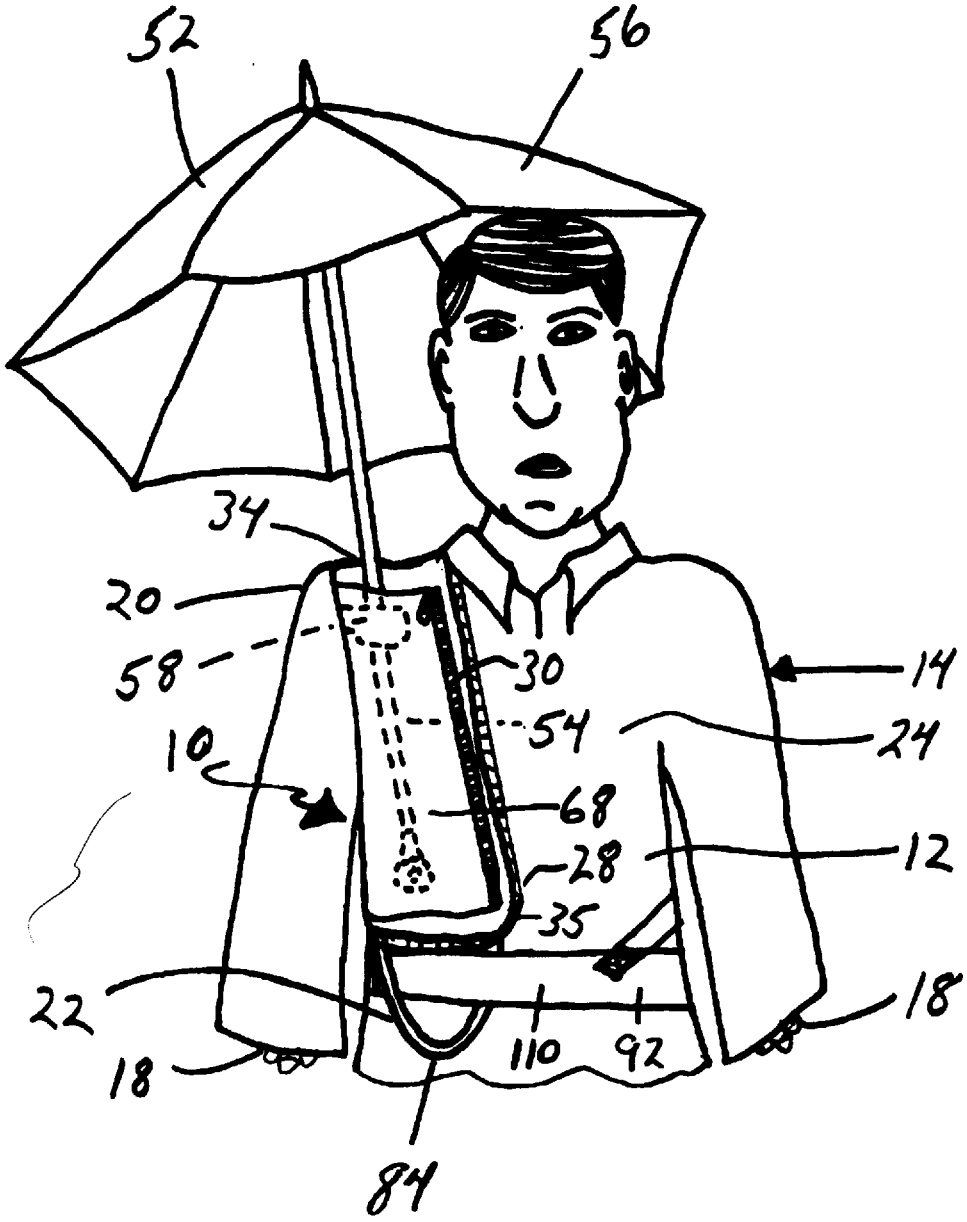
FIG. 1 is a diagrammatic front perspective view of the present invention attached to a torso and supporting a pop-up umbrella upright without the use of the hands.

LIST OF REFERENCE NUMERALS
UTILIZED IN THE DRAWING 10 holding device for attaching to a torso and supporting a pop-up umbrella upright without the use of hands of the present invention
12 torso of wearer 14
14 wearer
18 hands of wearer 14
20 shoulder of wearer 14
22 waist of wearer 14
24 chest of wearer 14
26 back of wearer 14
28 carrying case
30 front portion of carrying case 28
32 lowermost edge of front portion 30 of carrying case 28
34 uppermost edge of front portion 30 of carrying case 28
35 free periphery of front portion 30 of carrying case 28
36 back portion
37 inner surface of front portion 30 of carrying case 28
38 lowermost edge of back portion 36 of carrying case 28
40 uppermost edge of back portion 36 of carrying case 28
42 fold line of carrying case 28
44 free periphery of back portion 36 of carrying case 28
46 inner surface of back portion 36 of carrying case 28
48 portion of carrying case zipper extending completely along free periphery 35 of front portion 30 of carrying case 28
50 mating portion of carrying case zipper extending completely along free periphery 34 of back portion 36 of carrying case 28
51 sleeve pivotally mounted on inner surface 37 of front portion 30 of carrying case 28
52 pop-up umbrella on inner surface 37 of front portion 30 of carrying case 28
54 shaft of pop-up umbrella 52
56 canopy of pop-up umbrella 52
58 umbrella shaft flap on inner surface 37 of front portion 30 of carrying case 28
60 one edge of umbrella shaft flap 58
62 free opposing edge of umbrella shaft flap 58
64 portion of umbrella shaft flap hook and loop fasteners on free opposing edge 62 of umbrella shaft flap 58
66 mating portion of umbrella shaft flap hook and loop fasteners 66 on inner surface 37 of front portion 30 of carrying case 28
68 umbrella storage flap
70 one longitudinal edge of umbrella storage flap 68
72 one longitudinal edge of free periphery 35 of front portion 30 of carrying case 28
74 free longitudinal opposing edge of umbrella storage flap 68
78 portion of a storage flap zipper on free opposing longitudinal edge 74 of umbrella storage flap 68
80 mating portion of storage flap zipper on inner surface 37 of front portion 30 of carrying case 28
82 other longitudinal edge 82 of free periphery 35 of front portion 30 of carrying case 28
84 carrying handle extending from lowermost edge 32 of front portion 30 of carrying case 28
86 medial strap
88 ends of medial strap 86 fixedly attached to inner surface 46 of back portion 36 of carrying case 28
90 longitudinal centerline of inner surface 46 of back portion 36 of carrying case 28
92 waist belt
94 intermediate point of waist belt 92
96 lowermost end of medial strap 86

-continued

| LIST OF REFERENCE NUMERALS UTILIZED IN THE DRAWING | |
|---|---|
| 98 | back strap |
| 100 | one end of back strap 98 |
| 102 | intermediate point of medial strap 86 |
| 104 | free end of back strap 98 |
| 106 | portion of back strap hook and loop fasteners on free end 104 of back strap 98 |
| 108 | mating portion of back strap hook and loop fasteners on waist belt 92 |
| 110 | front of waist belt 92 |
| 112 | strap flap |
| 114 | one edge of strap flap 112 fixedly attached to inner surface 46 of rear portion 36 of carrying case 28 |
| 116 | free opposing edge of strap flap 112 |
| 118 | portion of strap hook and loop fasteners on free opposing edge 116 of strap flap 112 |
| 120 | mating portion of strap hook and loop fasteners 120 on inner surface 46 of back portion 36 of carrying case 28 |

DETAILED DESCRIPTION OF THE PREFERRED EMBODIMENT

Figure 2:
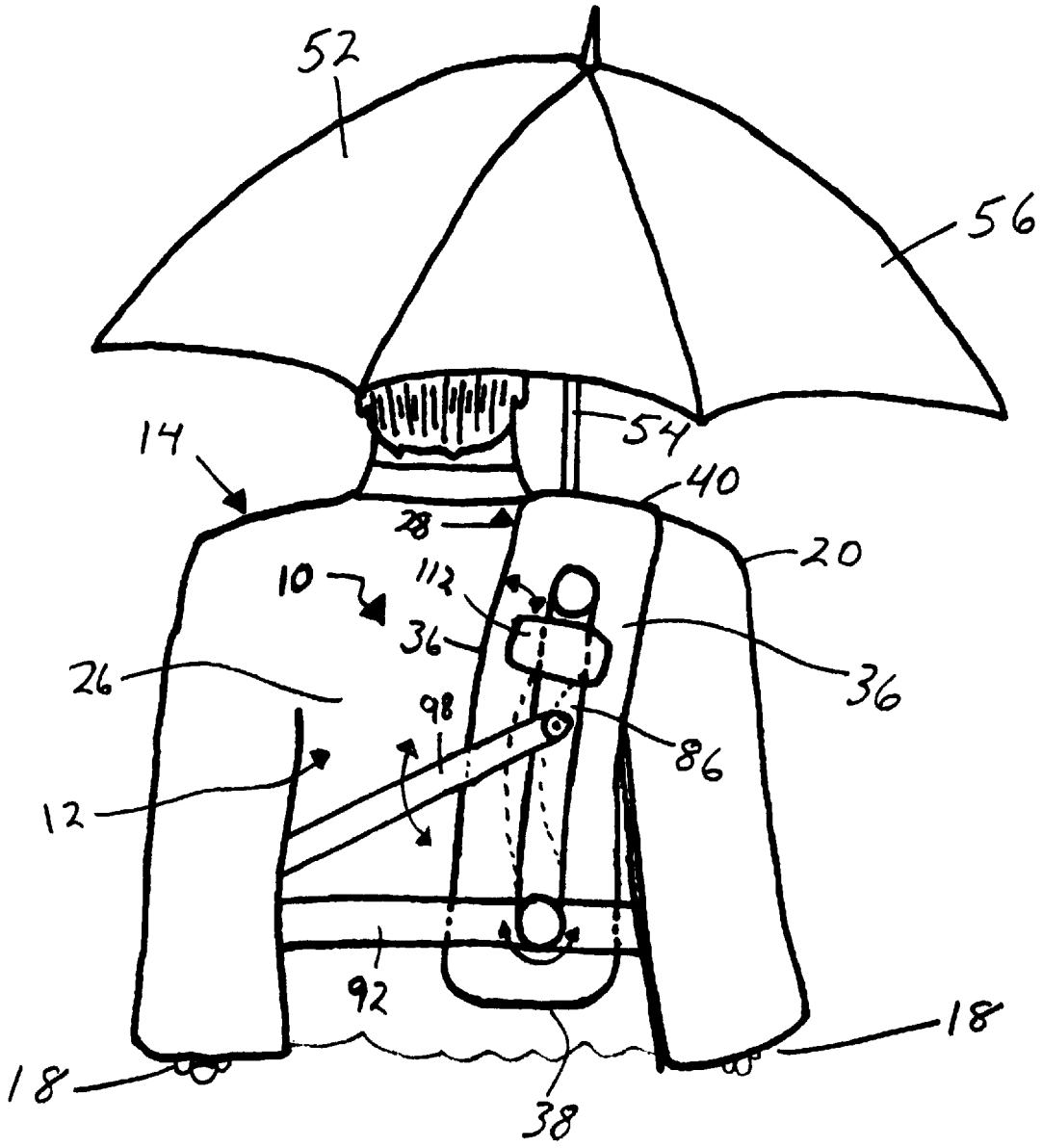
FIG. 2 is a diagrammatic rear perspective view of the present invention attached to a torso and supporting a pop-up umbrella upright without the use of the hands.
Figure 3:
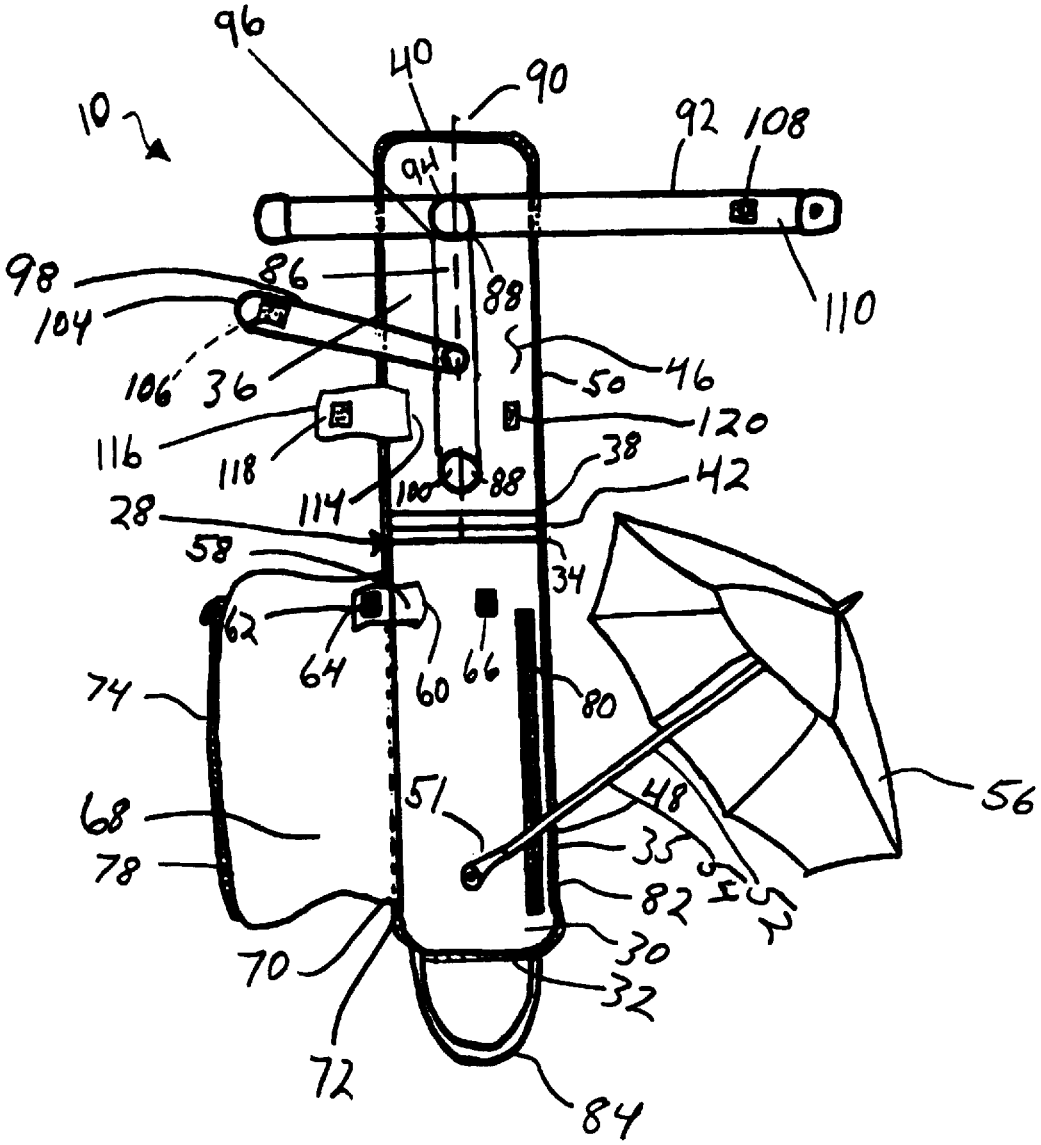
FIG. 3 is a diagrammatic top plan view of the present invention in the open position and ready to be donned for use.
Figure 4:
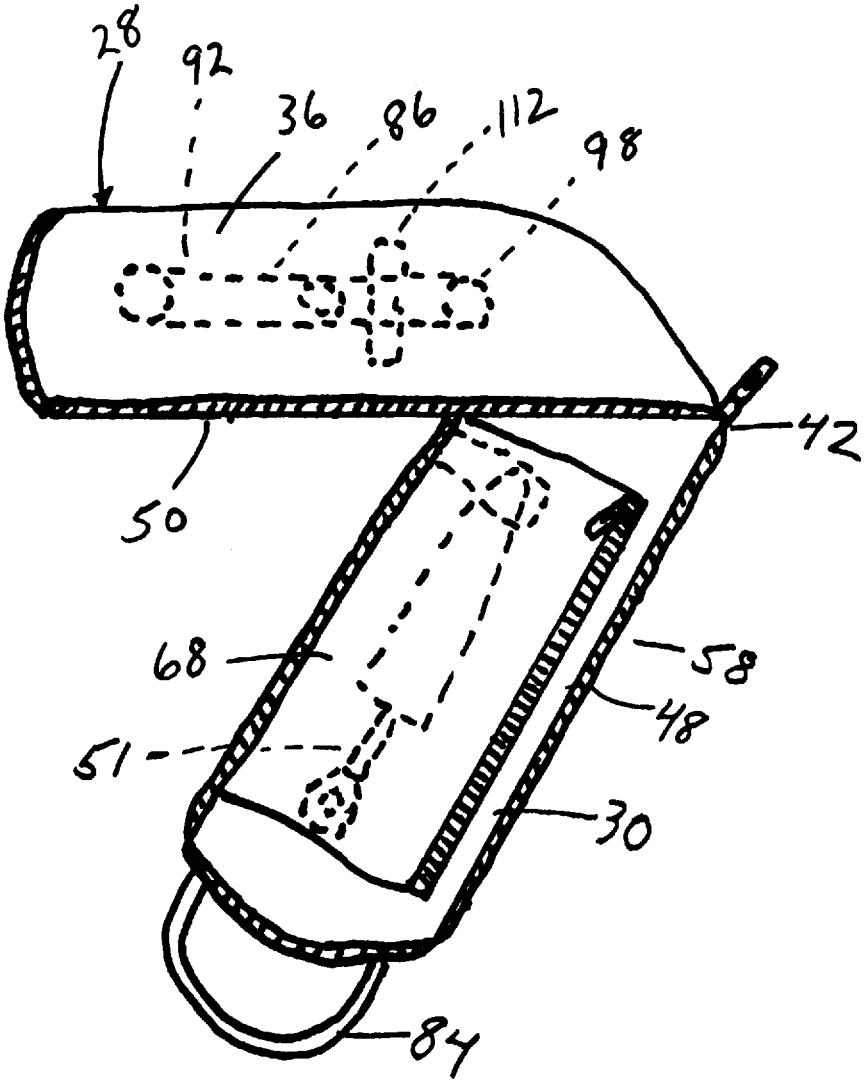
FIG. 4 is a diagrammatic perspective view of the present invention achieving the closed open position and ready to be carried.

Referring now to the figures, in which like numerals indicate like parts, and particularly to FIG. 1 and FIG. 2, the holding device of the present invention is shown generally at 10 for attaching to a torso 12 of a wearer 14 and supporting a pop-up umbrella upright without the use of the hands 18 of the wearer 14, wherein the wearer 14 has a shoulder 20, a waist 22, a chest 24, and a back 26.

The configuration of the holding device 10 can best be seen in FIG. 1, FIG. 2, FIG. 3, and FIG. 4, and as such, will be discussed with reference thereto. The holding device 10 comprises a carrying case 28 that has an open position when the holding device 10 is in its in-use position and a closed position when the holding device 10 is in its non-use position.

The carrying case 28 comprises a front portion 30 for overlying the chest 24 of the wearer 14 when the carrying case 28 is in its open position and the holding device 10 is in its in-use position. The front portion 30 of the carrying case 28 is flexible, elongated, and sheet-like.

The front portion 30 of the carrying case 28 is for extending at its lowermost edge 32 from the waist 22 of the wearer 14, overlying the chest 24 of the wearer 14, to the shoulder 20 of the wearer 14 at its uppermost edge 34 when the carrying case 28 is in its open position and the holding device 10 is in its in-use position.

The front portion 30 of the carrying case 28 has a free periphery 35 and an inner surface 37 for overlying the chest 24 of the wearer 14 when the carrying case 28 is in its open position and the holding device 10 is in its in-use position.

The carrying case 28 further comprises a back portion 36 for overlying the back 26 of the wearer 14 when the carrying case 28 is in its open position and the holding device 10 is in its in-use position. The back portion 36 of the carrying case 28 is flexible, elongated, and sheet-like.

The back portion 36 of the carrying case 28 is for extending at its lowermost edge 38 from the waist 22 of the wearer 14, overlying the back 26 of the wearer 14, to the shoulder 20 of the wearer 14 at its uppermost edge 40 where it forms a fold line 42 with the uppermost edge 34 of the front portion 30 of the carrying case 28 that is for overlying the shoulder 20 of the wearer 14 when the carrying case 28 is in its open position and the holding device 10 is in its in-use position.

The back portion 36 of the carrying case 28 a free periphery 44 and an inner surface 46 for overlying the back 26 of the wearer 14 when the carrying case 28 is in its open position and the holding device 10 is in its in-use position.

The holding device 10 further comprises a portion of a carrying case zipper 48 that extends completely along the free periphery 35 of the front portion 30 of the carrying case 28.

The holding device 10 further comprises a mating portion of a carrying case zipper 50 that extends completely along the free periphery 34 of the back portion 36 of the carrying case 28.

The mating portion of a carrying case zipper 50 engages the portion of a zipper 48 along the free periphery 35 of the front portion 30 of the carrying case 28 when the holding device 10 is in its non-use position and the carrying case 28 is in its closed position, and disengages the portion of a zipper 48 along the free periphery 35 of the front portion 30 of the carrying case 28 when the carrying case 28 is in its open position.

The holding device 10 further comprises a sleeve 51 that is pivotally mounted on the inner surface 37 of the front portion 30 of the carrying case 28 in close proximity to the lowermost edge 32 of the front portion 30 of the carrying case 28.

The holding device 10 further comprises a pop-up umbrella 52 that has an open position, a closed position, and a shaft 54 that is captured in the sleeve 51 on the inner surface 37 of the front portion 30 of the carrying case 28 for lateral pivotal movement therewith so as to allow the pop-up umbrella 52 to pivot away from the wearer 14 before being opened and thereby preventing injury to the wearer 14 when the carrying case 28 is in its open position and the holding device 10 is in its in-use position, and a canopy 56 that is collapsible onto the shaft 54 of the pop-up umbrella 52.

The holding device 10 further comprises an umbrella shaft flap 58 that is fixed at one edge 60 to the inner surface 37 of the front portion 30 of the carrying case 28 in close proximity to the uppermost edge 34 of the front portion 30 of the carrying case 28 and extends laterally to a free opposing edge 62.

The umbrella shaft flap 58 on the inner surface 37 of the front portion 30 of the carrying case 28 overlies the shaft 54 of the pop-up umbrella 52 when the carrying case 28 is in its open position and the pop-up umbrella 52 is in its open position and the holding device 10 is in its in-use position, and maintains the shaft 54 of the pop-up umbrella 52 upright by hook and loop fasteners 64 on the free opposing edge 62 of the umbrella shaft flap 58 mating with hook and loop fasteners 66 on the inner surface 37 of the front portion 30 of the carrying case 28.

The holding device 10 further comprises an umbrella storage flap 68 that is fixed at one longitudinal edge 70 to one longitudinal edge 72 of the free periphery 35 of the front portion 30 of the carrying case 28, and extends laterally to a free longitudinal opposing edge 74.

The umbrella storage flap 60 overlies the pop-up umbrella 52 in its majority when the pop-up umbrella 52 is in its closed position and the holding device 10 is in its non-use position, and maintains the pop-up umbrella 52 thereat by a storage flap zipper 78 on the free opposing longitudinal edge 74 of the umbrella storage flap 68 engaging with a mating storage flap zipper 80 on the inner surface 37 of the front portion 30 of the carrying case 28. The storage flap zipper 78 is parallel to and in close proximity of the other longitudinal edge 82 of the free periphery 35 of the front portion 30 of the carrying case 28.

The holding device 10 further comprises a carrying handle 84 that is a closed loop of material that extends from the lowermost edge 32 of the front portion 30 of the carrying case 28, and functions as a carrying handle when the holding device 10 is in its non-use position and the carrying case 28 is in its closed position.

The holding device 10 further comprises a medial strap 86 that is elastic and laterally deflectable and fixedly attached at its ends 88 to the inner surface 46 of the back portion 36 of the carrying case 28 along a longitudinal centerline 90.

The holding device 10 further comprises a waist belt 92 that is elastic and pivotally attached at an intermediate point 94 to the medial strap 86 at its lowermost end 96.

The waist belt 92 is adapted for adjustably encircling the waist 22 of the wearer 14, and passes through the carrying handle 84 when the carrying case 28 is in its open position and the holding device 10 is in its in-use position, and thereby maintains the front portion 30 of the carrying case 28 against the chest 24 of the wearer 14 and the back portion 36 of the carrying case 28 against the back 26 of the wearer 14, and the waist belt 92 is removed from the carrying handle 84 and pivoted along the medial strap 86 when the holding device 10 is in its non-use position.

The holding device 10 further comprises a back strap 98 that is elastic and pivotally mounted at one end 100 to the medial strap 86 at an intermediate point 102 thereof.

The back strap 98 causes the medial strap 86 to deflect slightly sidewardly and adapted to extend obliquely downwardly and outwardly over the back 26 of the wearer 14, under an opposing arm of the wearer 14, around a portion of the torso 12 of the wearer 14, to the waist belt 92, where its free end 104 is maintained thereat by back strap hook and loop fasteners 106 thereon that mates with back strap hook and loop fasteners 108 on the waist belt 92 at its front 110 when the carrying case 28 is in its open position and the holding device 10 is in its in-use position, and pivoted along the medial strap 86 when the holding device 10 is in its non-use position.

The holding device 10 further comprises a strap flap 112 that is fixed at one edge 114 to the inner surface 46 of the rear portion 36 of the carrying case 28, wherein the strap flap 112 is in close proximity to the uppermost edge 38 of the back portion 36 of the carrying case 28 at one side of the medial strap 86 and extends laterally to a free opposing edge 116.

The strap flap 112 on the inner surface 46 of the back portion 36 of the carrying case 28 overlies the waist belt 92 and the back strap 98 when the holding device 10 is in its non-use position, and maintains the waist belt 92 and the back strap 98 along the medial strap 86 by strap hook and loop fasteners 118 on the free opposing edge 116 of the strap flap 112 mating with strap hook and loop fasteners 120 on the inner surface 46 of the back portion 36 of the carrying case 28.

It will be understood that each of the elements described above, or two or more together, may also find a useful application in other types of constructions differing from the types described above.

While the invention has been illustrated and described as embodied in a device for attaching to a torso and supporting a pop-up umbrella without the use of hands, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A holding device for attaching to a torso and supporting a pop-up umbrella upright without the use of hands of a wearer and having an in-use position where it is releasably attached to the torso of the wearer and a non-use position where it is removed from the torso of the wearer and stowed away for easy transport, said holding device comprising:

a) a carrying case having an open position when said holding device is in its in-use position and a closed position when said holding device is in its non-use position; said carrying case comprising a front portion for overlying the chest of the wearer when said carrying case is in its open position and said holding device is in its in-use position; said front portion of said carrying case being flexible, elongated, and sheet-like; said front portion of said carrying case extending at its lowermost edge from the waist of the wearer, overlying the chest of the wearer, to a shoulder of the wearer at its uppermost edge when said carrying case is in its open position and said holding device is in its in-use position; said front portion of said carrying case having a free periphery and an inner surface for overlying the chest of the wearer when said carrying case is in its open position and said holding device is in its in-use position; said carrying case further comprising a back portion for overlying the back of the wearer when said carrying case is in its open position and said holding device is in its in-use position; said back portion of said carrying case being flexible, elongated, and sheet-like; said back portion of said carrying case extending at its lowermost edge from the waist of the wearer, overlying the back of the wearer, to the shoulder of the wearer at its uppermost edge where it forms a fold line with said uppermost edge of said front portion of said carrying case being for overlying the shoulder of the wearer when said carrying case is in its open position and said holding device is in its in-use position; said back portion of said carrying case having a free periphery and an inner surface for overlying the back of the wearer when said carrying case is in its open position and said holding device is in its in-use position;

b) a sleeve pivotally mounted in said carrying case; said sleeve being pivotally mounted on said inner surface of said front portion of said carrying case in close proximity to said lowermost edge of said front portion of said carrying case;

c) a pop-up umbrella having an open position, a closed position, and a shaft captured in said sleeve for lateral pivotal movement therewith so as to allow said pop-up umbrella to pivot away from the wearer before being opened and thereby prevent injury to the wearer when said carrying case is in its open position and said holding device is in its in-use position;

d) means for releasably attaching said carrying case to the torso of the wearer when said carrying case is in its open position and said holding device is in its in-use position;

e) a portion of a carrying case zipper extending completely along said free periphery of said front portion of said carrying case; and f) a mating portion of a carrying case zipper extending completely along said free periphery of said back portion of said carrying case; said mating portion of a carrying case zipper engaging said portion of said zipper along said free periphery of said front portion of said carrying case when said holding device is in its non-use position and said carrying case is in its closed position, and disengaging said portion of a zipper along said free periphery of said front portion of said carrying case when said carrying case is in its open position.

2. The device as defined in claim 1; further comprising an umbrella shaft flap fixed at one edge to said inner surface of said front portion of said carrying case in close proximity to said uppermost edge of said front portion of said carrying case and extends laterally to a free opposing edge.

3. The device as defined in claim 2, wherein said umbrella shaft flap overlies said shaft of said pop-up umbrella when said carrying case is in its open position and said pop-up umbrella is in its open position and said holding device is in its in-use position, and maintains said shaft of said pop-up umbrella upright by hook and loop fasteners on said free opposing edge of said umbrella shaft flap mating with hook and loop fasteners on said inner surface of said front portion of said carrying case.

4. The device as defined in claim 1; further comprising an umbrella storage flap fixed at one longitudinal edge to one longitudinal edge of said free periphery of said front portion of said carrying case, and extending laterally to a free longitudinal opposing edge.

5. The device as defined in claim 4, wherein said umbrella storage flap overlies said pop-up umbrella, in its majority, when said pop-up umbrella is in its closed position and said holding device is in its non-use position, and maintains said pop-up umbrella thereat by a storage flap zipper on said free opposing longitudinal edge of said umbrella storage flap engaging with a mating storage flap zipper on said inner surface of said front portion of said carrying case; said storage flap zipper is parallel to and in close proximity of the other longitudinal edge of said free periphery of said front portion of said carrying case.

6. The device as defined in claim 1; further comprising a carrying handle being a closed loop of material extending from said lowermost edge of said front portion of said carrying case, and functioning as a carrying handle when said holding device is in its non-use position and said carrying case is in its closed position.

7. The device as defined in claim 1, wherein said means includes a medial strap that is elastic and laterally deflectable and fixedly attached at its ends to said inner surface of said back portion of said carrying case along a longitudinal centerline.

8. The device as defined in claim 7, wherein said means further includes a waist belt that is elastic and pivotally attached at an intermediate point thereof to said medial strap at its lowermost end.

9. The device as defined in claim 8, wherein said waist belt is adapted for adjustably encircling the waist of the wearer, and passes through said carrying handle when said carrying case is in its open position and said holding device is in its in-use position, and thereby maintains said front portion of said carrying case against the chest of the wearer and said back portion of said carrying case against the back of said wearer, and said waist belt is removed from said carrying handle and pivoted along said medial strap when said holding device is in its non-use position.

10. The device as defined in claim 8, wherein said means further includes a back strap that is elastic and pivotally mounted at one end thereof to said medial strap at an intermediate point thereof.

11. The device as defined in claim 10, wherein said back strap causes said medial strap to deflect slightly sidewardly and adapted to extend obliquely downwardly and outwardly over the back of the wearer, under an opposing arm of the wearer, around a portion of the torso of the wearer, to said waist belt, where its free end is maintained thereat by back strap hook and loop fasteners thereon that mates with back strap hook and loop fasteners on said waist belt, at its front, when said carrying case is in its open position and said holding device is in its in-use position, and pivoted along said medial strap when said holding device is in its non-use position.

12. The device as defined in claim 10, further comprising a strap flap fixed at one edge thereof to said inner surface of said rear portion of said carrying case, wherein said strap flap is in close proximity to said uppermost edge of said back portion of said carrying case, at one side of said medial strap, and extends laterally to a free opposing edge.

13. The device as defined in claim 12, wherein said strap flap overlies said waist belt and said back strap when said holding device is in its non-use position, and maintains said waist belt and said back strap along said medial strap by strap hook and loop fasteners on said free opposing edge of said strap flap mating with strap hook and loop fasteners on said inner surface of said back portion of said carrying case.

* * * * *